US006389634B1

(12) United States Patent
Devlin et al.

(10) Patent No.: US 6,389,634 B1
(45) Date of Patent: May 21, 2002

(54) ORAL DEVICES

(75) Inventors: Thomas E. Devlin, Somerville; Michael F. Roberts, Braintree, both of MA (US); Phillip M. Braun, Exeter, RI (US)

(73) Assignee: Gillette Canada Company, Halifax (CA)

( * ) Notice: Subject to any disclaimer, the term of this patent is extended or adjusted under 35 U.S.C. 154(b) by 0 days.

(21) Appl. No.: 09/421,747

(22) Filed: Oct. 20, 1999

Related U.S. Application Data

(63) Continuation-in-part of application No. 09/199,122, filed on Nov. 24, 1998, now abandoned.

(51) Int. Cl.[7] ..... A46B 7/10; A46B 9/04; A61H 13/00

(52) U.S. Cl. ..... 15/110; 15/27; 15/167.1; 15/188; 601/141

(58) Field of Search ..... 15/27, 106, 110, 15/167.1, 188; 132/309; 601/139, 141; D4/104, 108, 109

(56) References Cited

U.S. PATENT DOCUMENTS

| | | | | | |
|---|---|---|---|---|---|
| 1,091,090 | A | * | 3/1914 | Tacail | 601/141 |
| 1,153,409 | A | * | 9/1915 | Wheeler | 601/141 |
| 1,188,134 | A | | 6/1916 | Arbat | 15/26 |
| 1,544,404 | A | | 6/1925 | Hummel | 15/246 |
| 1,593,763 | A | | 7/1926 | Henderson | 15/23 |
| 1,693,229 | A | | 11/1928 | Felmar | 15/167.1 |
| 1,758,632 | A | | 5/1930 | Wagner | 15/167.1 |
| 1,872,832 | A | * | 8/1932 | Silverberg | 601/141 |
| 2,093,007 | A | | 9/1937 | Chott | 15/246 |
| 2,175,975 | A | | 10/1939 | Steiner | 15/22.1 |
| 2,220,053 | A | * | 10/1940 | Pruner | 15/27 |
| 2,246,867 | A | | 6/1941 | Thomas et al. | 15/110 |
| 2,583,886 | A | | 1/1952 | Schlegel | 15/23 |
| 2,628,377 | A | | 2/1953 | Cockriel | 15/23 |
| 2,653,598 | A | * | 9/1953 | Torino | 601/141 |
| 2,655,674 | A | | 10/1953 | Grover | 15/23 |
| 2,655,675 | A | | 10/1953 | Grover | 15/23 |
| 2,655,676 | A | | 10/1953 | Grover | 15/23 |
| 2,935,755 | A | | 5/1960 | Leira et al. | 15/167.1 |
| 3,082,457 | A | | 3/1963 | Lucibello et al. | 15/167.1 |
| 3,386,118 | A | | 6/1968 | Morioku et al. | 15/181 |
| 3,683,442 | A | | 8/1972 | Holly | 15/167.1 |
| 3,742,608 | A | | 7/1973 | Jones | 433/146 |
| 3,903,906 | A | | 9/1975 | Collis | 132/200 |
| 3,984,890 | A | | 10/1976 | Collis | 15/22.1 |
| 4,317,463 | A | | 3/1982 | Massetti | 15/167.1 |
| 4,428,091 | A | | 1/1984 | Janssen | 15/167.2 |
| 4,534,081 | A | | 8/1985 | Spademan | 15/167.1 |
| 4,694,844 | A | | 9/1987 | Berl et al. | 15/167.1 |
| 4,979,256 | A | | 12/1990 | Branford | 15/27 |
| 5,120,225 | A | | 6/1992 | Amit | 433/216 |
| 5,184,368 | A | | 2/1993 | Holland | 15/167.1 |
| 5,186,627 | A | | 2/1993 | Amit et al. | 433/216 |
| 5,342,284 | A | | 8/1994 | Lemon et al. | 601/141 |
| 5,546,626 | A | | 8/1996 | Chung | 15/167.1 |
| 5,623,746 | A | | 4/1997 | Ichiro | 15/22.2 |
| 5,658,148 | A | | 8/1997 | Neuberger et al. | 433/215 |
| 5,660,546 | A | | 8/1997 | Shafer | 433/216 |

FOREIGN PATENT DOCUMENTS

| | | |
|---|---|---|
| DE | 1112966 | 8/1961 |
| EP | 520 985 | 1/1993 |
| FR | 1.300.138 | 6/1962 |
| GB | 989953 | 4/1965 |

* cited by examiner

*Primary Examiner*—Mark Spisich
(74) *Attorney, Agent, or Firm*—Fish & Richardson P.C.

(57) ABSTRACT

Oral devices are provided, including oral brushes that include bristle tufts and a rotatable member having radially extending tips constructed to penetrate the interproximal and subgingival regions of the oral cavity.

35 Claims, 18 Drawing Sheets

ORAL DEVICES

This application Ser. No. 09/421,747, filed Oct. 20, 1999, is a continuation-in-part of application Ser. No. 09/199,122, filed Nov. 24, 1998, abandoned.

BACKGROUND OF THE INVENTION

The present invention relates to oral devices, e.g., oral brushes.

Conventional toothbrushes, having tufts of bristles mounted on a head, are generally effective at removing plaque from the flat surfaces of teeth and the areas between teeth and along the gumline that can be accessed by the bristles. However, such toothbrushes typically cannot clean interproximal and sub-gingival areas where tufts of bristles are unable to penetrate or reach. This is because the bristles tend to pass or flick over the gaps between the teeth and are usually physically impeded from reaching behind the interdental papillae and below the gumline. To clean these areas (col and sub-gingival areas), it is generally necessary to floss between the teeth with dental floss.

While flossing effectively cleans the supra-gingival and sub-gingival regions between teeth, many people do not floss regularly. Failing to floss regularly may result in gingivitis, which can lead to more serious gum diseases. These problems can occur despite regular toothbrushing.

SUMMARY OF THE INVENTION

The invention features oral devices, such as oral brushes, that are capable of providing interproximal and sub-gingival cleaning and/or gingival stimulation during brushing of the teeth. It is believed that these oral brushes provide clinical benefits, e.g., reduction of gingivitis, to users who do not floss regularly but who do use the oral brush regularly, relative to the benefits provided by using a conventional toothbrush with the same regularity without flossing.

In one aspect, the invention features an oral brush that includes a body having a head that is shaped for insertion into the oral cavity, tooth cleansing elements extending from a top surface of the head, and a rotatable element, mounted on the head, including a central portion and a plurality of protrusions extending radially from the central portion, each protrusion tapering from a relatively wide base to a relatively narrow tip.

Preferred embodiments of the invention include one or more of the following features. The rotatable element is mounted to rotate about an axis that is substantially parallel to the top surface of the head. The head includes a slot positioned to allow the rotatable element to rotate freely. The dimensions of the rotatable element, and the number of protrusions, are selected so that the tips are circumferentially spaced at intervals that correspond approximately to the average spacing of human teeth. The tips define a circle or a hemisphere. The tips are shaped to penetrate the interproximal and sub-gingival regions of the oral cavity, e.g., the tips have a thickness of less than 0.07 inch, more preferably less than 0.03 inch, and most preferably from about 0.005 to 0.025 inch. The tips are formed of a material having a durometer reading of from about 25 to 85 Shore A, more preferably about 55 to 75 Shore A. The tips are formed of a thermoplastic elastomer. The rotatable element is a single, integral part, and is formed of a thermoplastic elastomer. The tooth cleansing elements are selected from bristles, fins and elongated elastomeric members. The oral brush includes two rotatable elements. Each rotatable element is mounted to rotate about an axis of rotation that is substantially parallel to the top surface of the head. The axes of rotation of the rotatable elements define a plane that is substantially parallel to the top surface of the head. The axes of rotation are not collinear. The rotatable members are positioned at the end of the head. The rotatable members further include massaging protrusions that are shaped to massage the gums.

In another aspect, the invention features an oral brush that includes a body having a head shaped for insertion into the oral cavity, tooth cleansing elements extending from a top surface of the head, and a pair of rotatable elements, each rotatable element including (a) a central portion that is mounted on the head to rotate about an axis of rotation, and (b) a plurality of protrusions extending radially at spaced intervals about the circumference of the central portion, each protrusion having a tip that is shaped to penetrate the interproximal region of the oral cavity, the rotatable elements being mounted so that the axes of rotation are not collinear.

Preferred embodiments include one or more of the following features. The protrusions are selected from tufts of bristles, solid tapered members, fins, and combinations thereof. The protrusions are shaped to penetrate the sub-gingival area. The axes of rotation define a plane that is substantially parallel to the top surface of the head. The rotatable members are positioned at the end of the head. The ends of the tips of each rotatable member define a circle or a hemisphere.

The invention also features an oral care device that includes a body having a head shaped for insertion into the oral cavity, and a rotatable element mounted on the head. The rotatable element includes one or more of the features described above.

In another aspect, the invention features methods of cleansing the interproximal regions of the oral cavity using an oral brush of the invention.

The term "interproximal" refers to the areas between the teeth of a mammal.

Other features and advantages will become apparent from the following Description of the Preferred Embodiments, the drawings and the claims.

DESCRIPTION OF THE PREFERRED EMBODIMENTS

Figure 1:
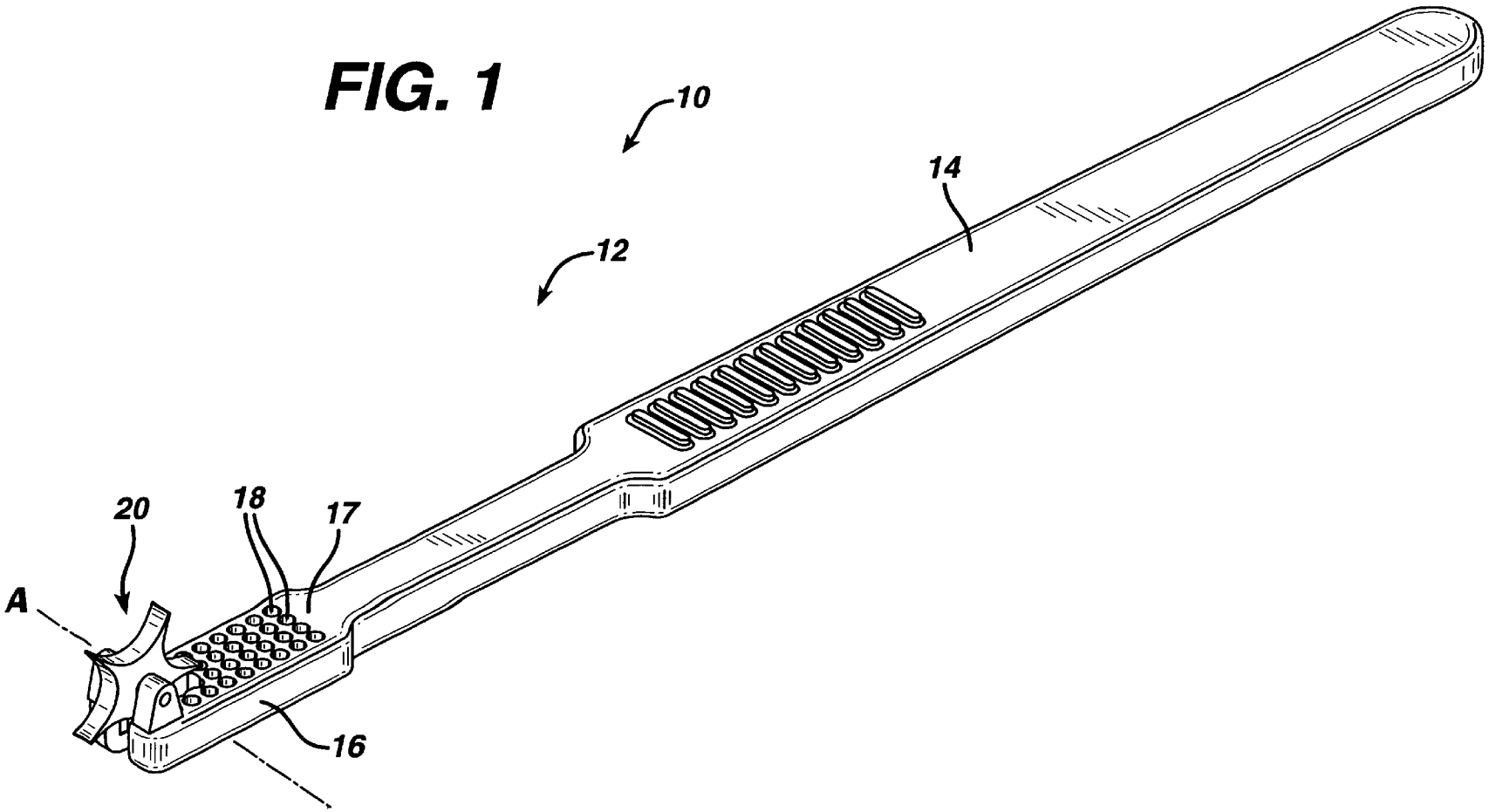
FIG. 1 is a perspective view of an oral brush according to one embodiment of the invention.
Figure 1A:
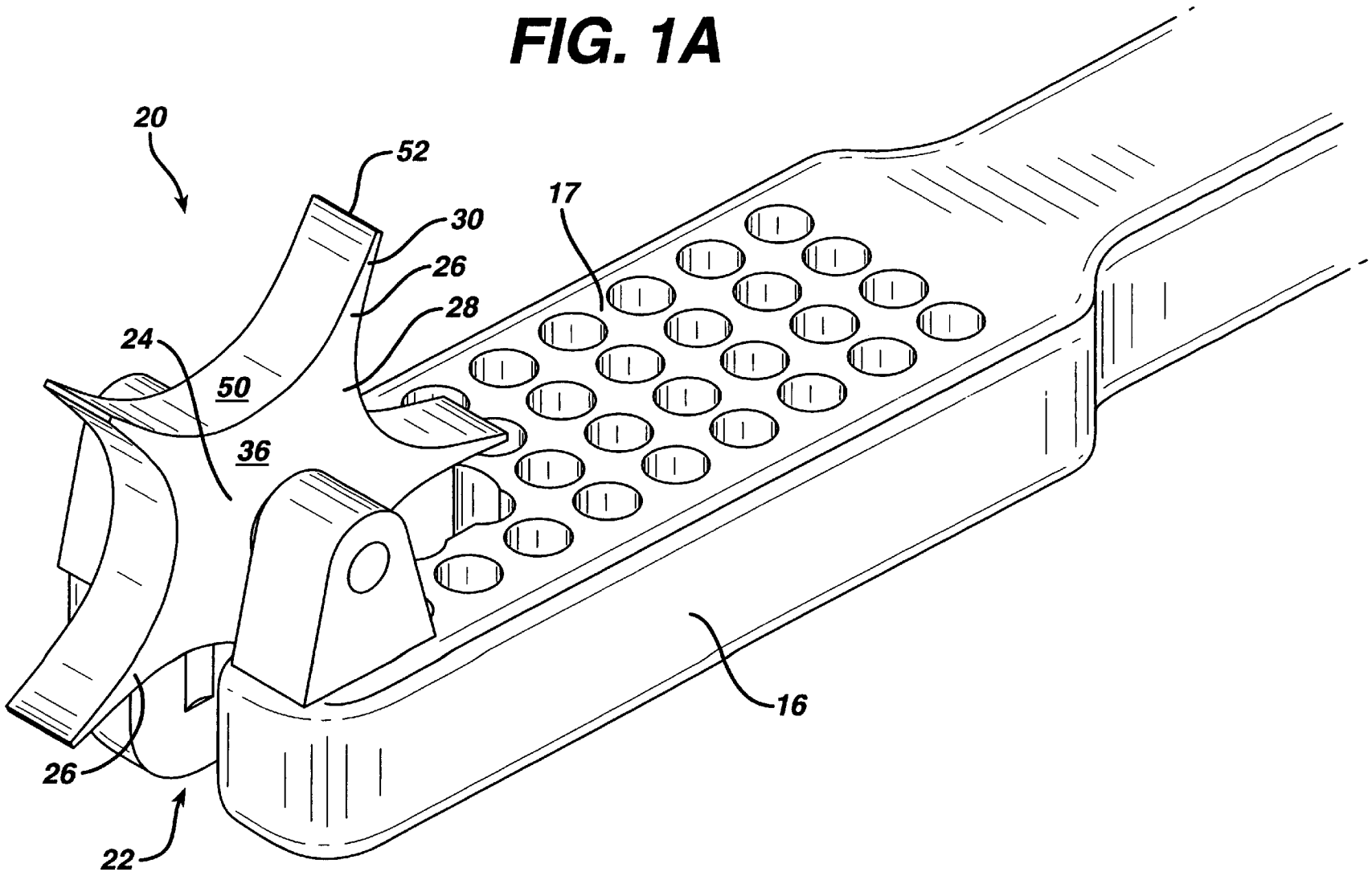
FIG. 1A is an enlarged detail view of the head of the oral brush of FIG. 1. Bristle tufts are omitted in these figures, for clarity.

Referring to FIG. 1, an oral brush 10 includes a body 12 that defines a handle 14 and a head 16. Head 16 includes a top surface 17 having a plurality of apertures 18 that are constructed to receive tooth cleansing elements, e.g., tufts of bristles (not shown). A wheel 20 is mounted forward of the bristles, for rotation about an axis A. As shown in FIG. 1A, head 16 includes a slot 22, extending through the thickness of the head in the area of the wheel, to allow the wheel 20 to spin freely about axis A.

Referring to FIG. 1A, the wheel 20 includes a central hub 24 and, extending radially from the hub, a plurality of tapered members 26. Each member 26 tapers from a relatively wide base 28 to a narrow tip 30. The preferred geometry of the members will be discussed in more detail below, with reference to FIGS. 4 and 4A.

Figure 2:
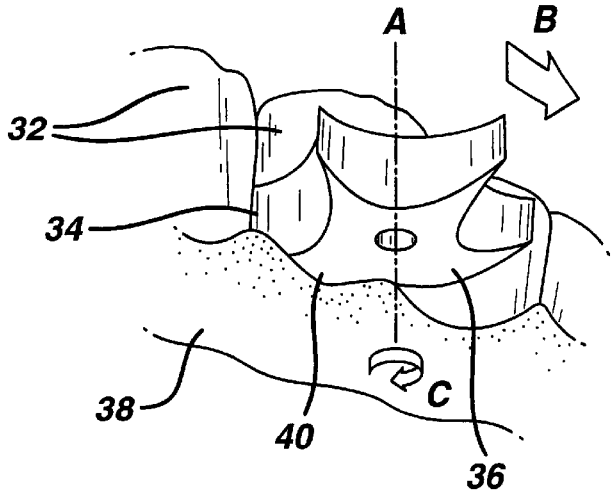
FIG. 2 is a schematic perspective view showing the rotatable element of the oral brush of FIG. 1 penetrating the interproximal region. The oral brush itself is omitted for clarity.

Referring now to FIG. 2, during brushing of the teeth using a back-and-forth movement (arrow B) the wheel 20 rotates about axis A as indicated by arrow C. Because the tips 30 are relatively thin and long, as the wheel rotates the tips penetrate between the teeth 32 into the interproximal regions 34. The side surface 36 of the wheel will also tend to contact the gums 38, resulting in cleaning and/or massaging of the supragingival area 40.

Figure 3:
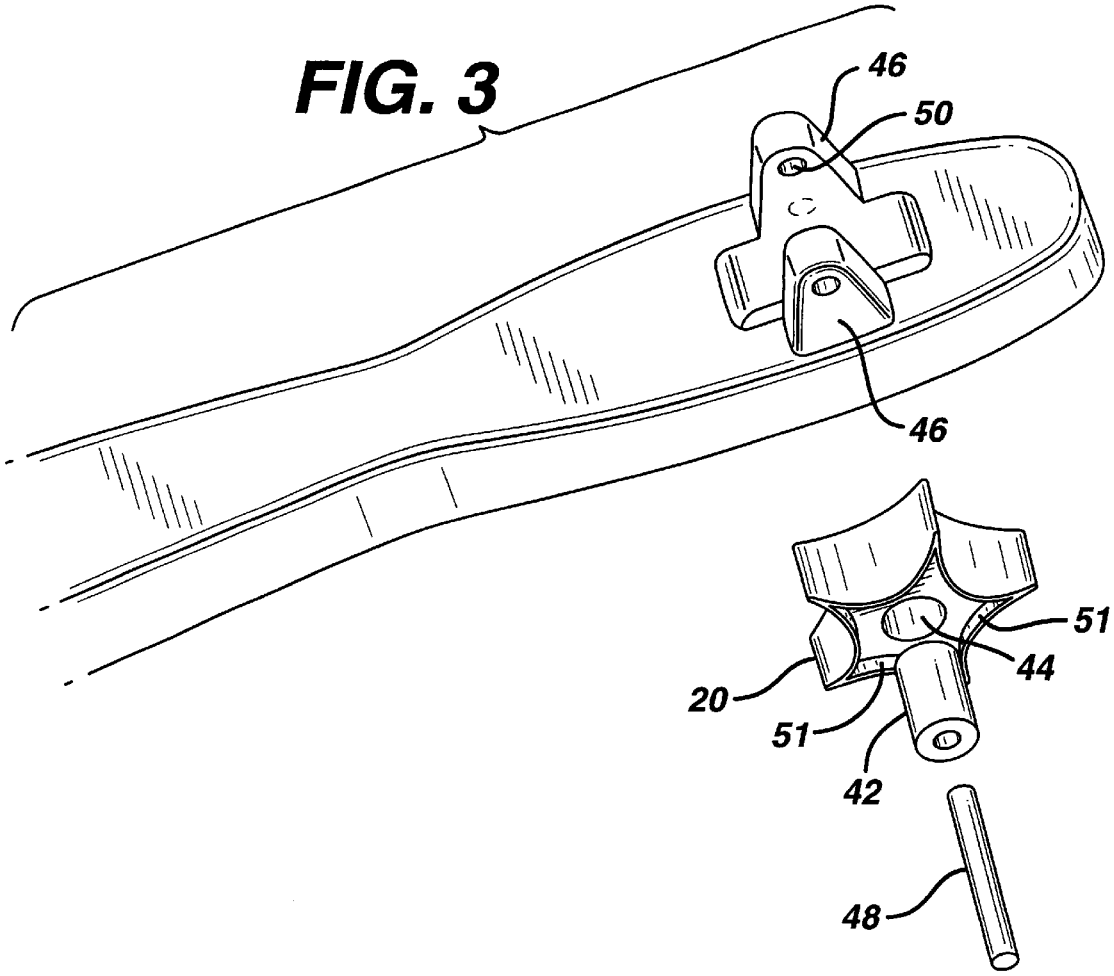
FIG. 3 is an exploded view of an oral brush according to one embodiment of the invention.
Figure 21A:
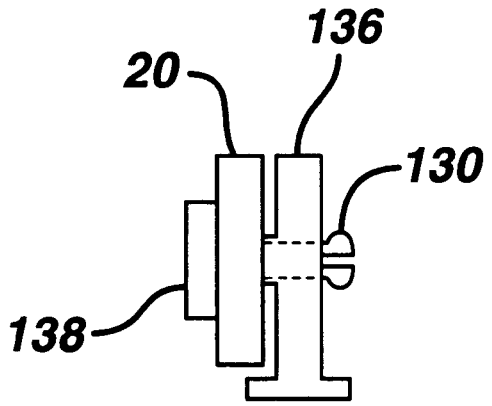
FIG. 21A is a view of a rotatable member secured to a support on an oral brush with a slotted pin.
Figure 21B:
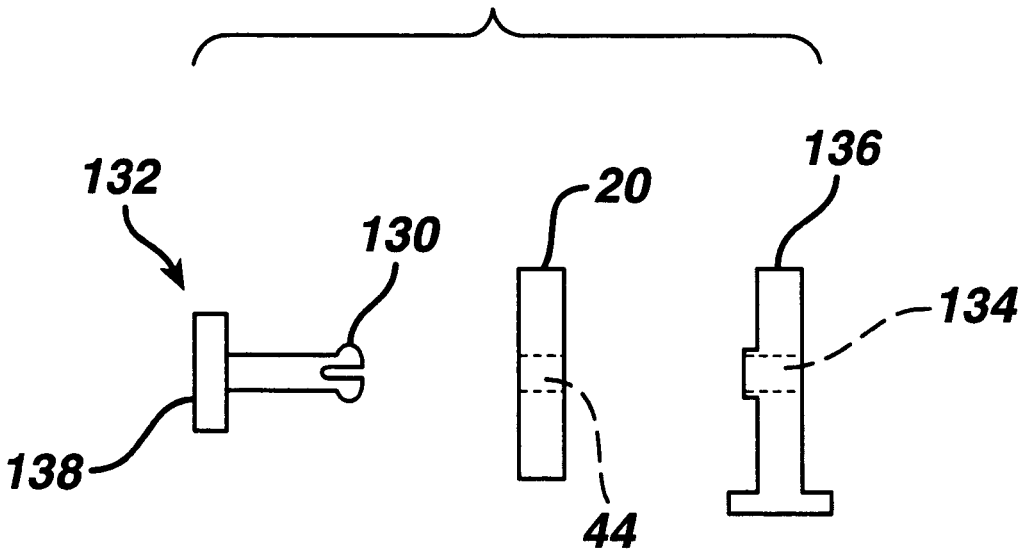
FIG. 21B is an exploded view of the secured rotatable member of FIG. 21.

One suitable technique for mounting the wheel 20 on the oral brush 10 is shown in FIG. 3. First, a bushing 42 is inserted into central bore 44 of wheel 20. The bushing/wheel assembly is then placed between supports 46, and pin 48 is inserted through apertures 50. Another suitable technique for mounting the wheel 20 on the oral brush 10 is shown in FIGS. 21A and 21B. The slotted end 130 of slotted pin 132 is inserted through central bore 44 of wheel 20 and through bore 134 in support 136 where, upon exiting support 136, slotted end 130 expands. The head 138 of slotted pin 132 and expanded slotted end 130 maintains wheel 20 in position on support 136. Many other techniques can be used, provided that the wheel is securely fastened to the oral brush.

FIG. 3 also shows another, optional, feature of the oral brush. The wheel 20 shown in FIG. 3 includes a web 51 that extends axially from the outer edge of the wheel. Web 51 preferably extends from about 0.2 to 0.4 inch, and is integrally molded onto the wheel. Web 51 is positioned to contact the gums during rotation of the wheel, to provide massaging, stimulation and/or cleaning of the gums.

Figure 4:
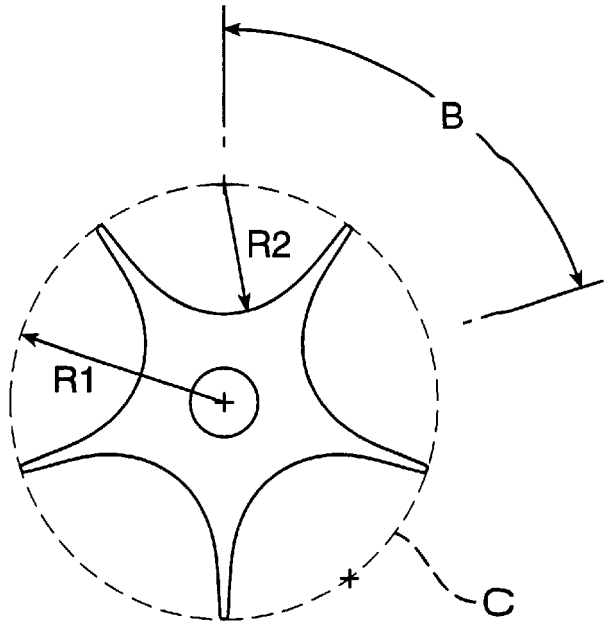
FIGS. 4 and 4A are, respectively, a front plan view and a perspective view of the rotatable element of the oral brush of FIG. 1.
Figure 4A:
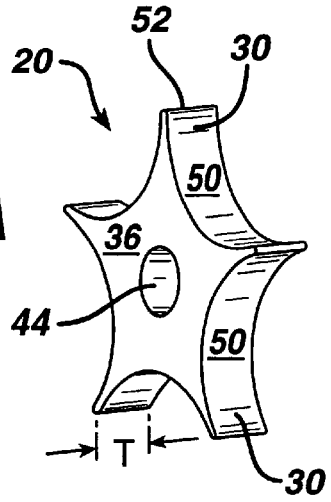

A preferred wheel geometry is shown in FIGS. 4 and 4A. The wheel is generally star-shaped, with five members 26 equally spaced about its circumference. The five members are substantially equal in their dimensions, and the tips 30 of the members define a circle C. The radius R1 of circle C (equal to the distance from the center of the central bore 44 to the terminal edge 52 of any one of the tips) is preferably from about 0.2 to 0.5 inch. The outer circumferential surfaces 50 of the wheel, between the tips 30, each define an arc having a radius of curvature R2 of from about 0.1 to 0.4 inch. The effective tip length, i.e., the portion of the wheel that will penetrate between two adjacent teeth, is approximately equal to R2. The tips taper to a thickness, at their terminal edge 52, of from about 0.005 to 0.025 inch. It is noted that the terminal portion of each tip is tapered to a thickness that is less than the thickness that would be dictated by the radius of curvature R2 (following the curve of circumferential surface 50 out to the terminal end 52 would result in the tip becoming undesirably wider towards the terminal end). The wheel has a thickness T of from about 0.02 to 0.15 inch.

The angle B between the lowest point of one of the surfaces 50 and the lowest point of the adjacent surface is necessarily about 72° (i.e., 360° divided by five) for the five-membered wheel shown. It is believed that this angle between members, combined with the preferred radiuses discussed above, provides a desirable spacing between the tips for penetrating the interproximal regions, i.e. a spacing that corresponds approximately to the average spacing of human teeth. By changing the diameter of the wheel, the same spacing can be obtained using more or fewer members. Moreover, if a different spacing is desired this can be obtained in similar manner.

Suitable materials for the wheel 20 include those which are safe for use in the oral cavity and which have suitable mechanical properties. The material used to form wheel 20 is preferably relatively soft and flexible, to avoid user discomfort and to allow the tips to flex during brushing to better penetrate the interproximal region. Preferably, the tip material has a durometer reading of from about 25 to 85 Shore A, more preferably about 40 to 85 Shore A and most preferably about 55 to 75 Shore A. For some embodiments, tapered members 26 having a hardness of from about 55 Shore A to about 85 Shore A, more preferably from about 65 Shore A to about 80 Shore A. Tapered members having a hardness of from about 70 Shore A to about 75 Shore A provide a desirable balance of effective cleaning between teeth and comfort to the user during brushing.

To obtain these properties, the tips 30 are preferably formed of a thermoplastic elastomer. Suitable thermoplastic elastomers include, e.g., KRATON rubber-based block copolymers such as DYNAFLEX G2701 and DYNAFLEX G2755 polymers, commercially available from GLS Corporation, Cary, Ill. The tips 30 can be comolded with the rest of the wheel, allowing the rest of the wheel to be formed of a different material. In this case, the tips can be formed of a relatively harder material, to aid penetration of the tips between the teeth. Suitable tip materials include KRATON rubber-based block copolymers having a hardness of about 70–90 Shore A, e.g., DYNAFLEX G2780 polymer.

Figure 4B:
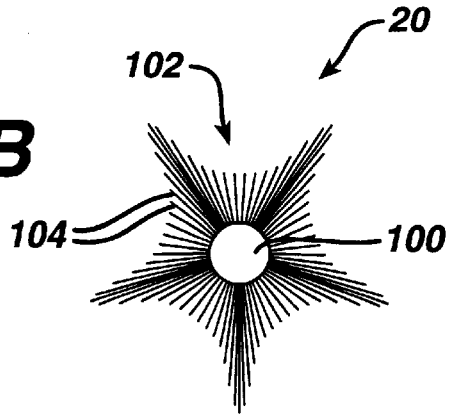
FIG. 4B,is a front plan view of a rotatable element according to an alternate embodiment of the invention.

Alternatively, as shown in FIG. 4B, the wheel 20 may include a central hub 100 and a plurality of bristles 102 extending radially from the hub, the bristle tips 104 defining the star shape of the wheel, or any other desired wheel shape. The bristles may be trimmed to the desired shape after mounting on the hub, or bristles having the desired relative lengths can be mounted on the hub.

Figure 5:
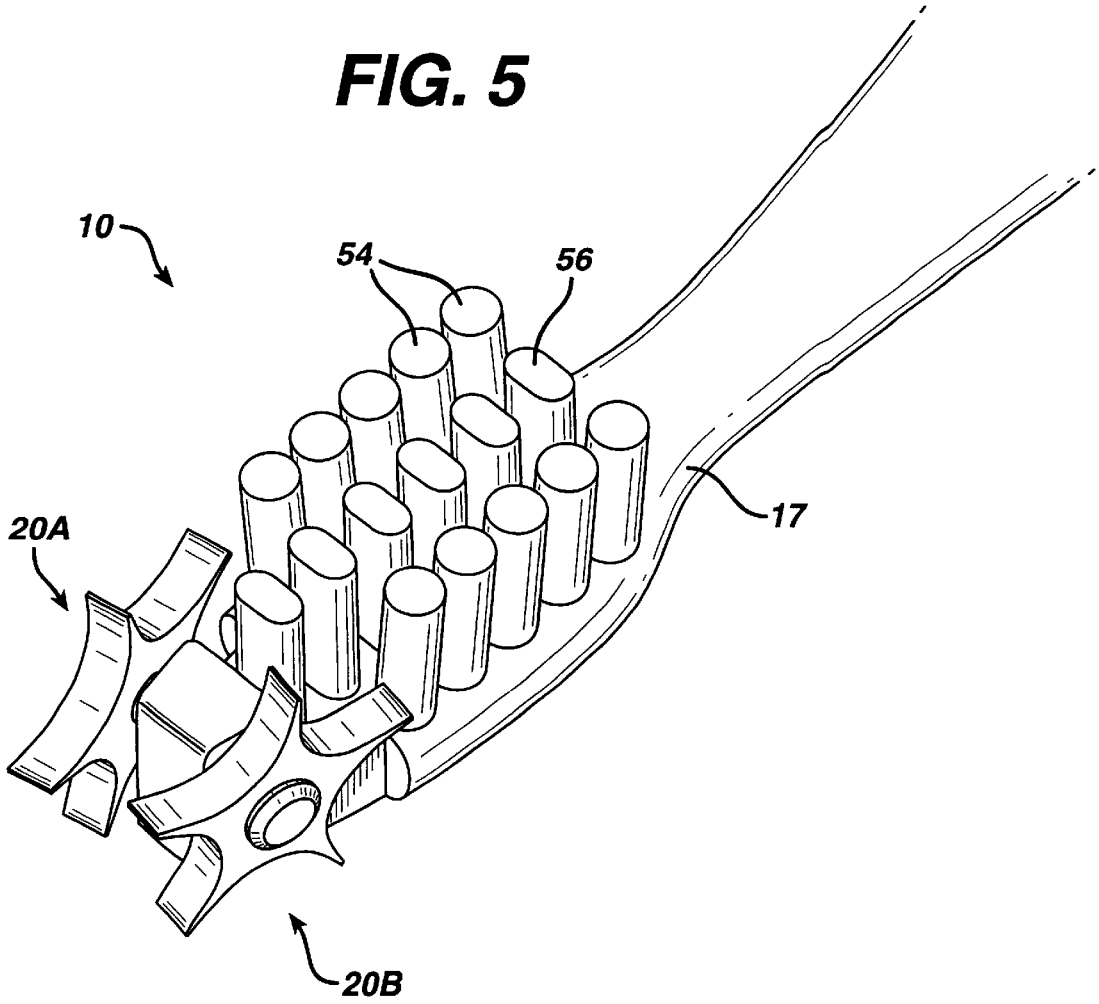
FIGS. 5, 6, 7 and 8 are enlarged detail perspective views of the heads of oral brushes according to various alternate embodiments of the invention.
Figure 5A:
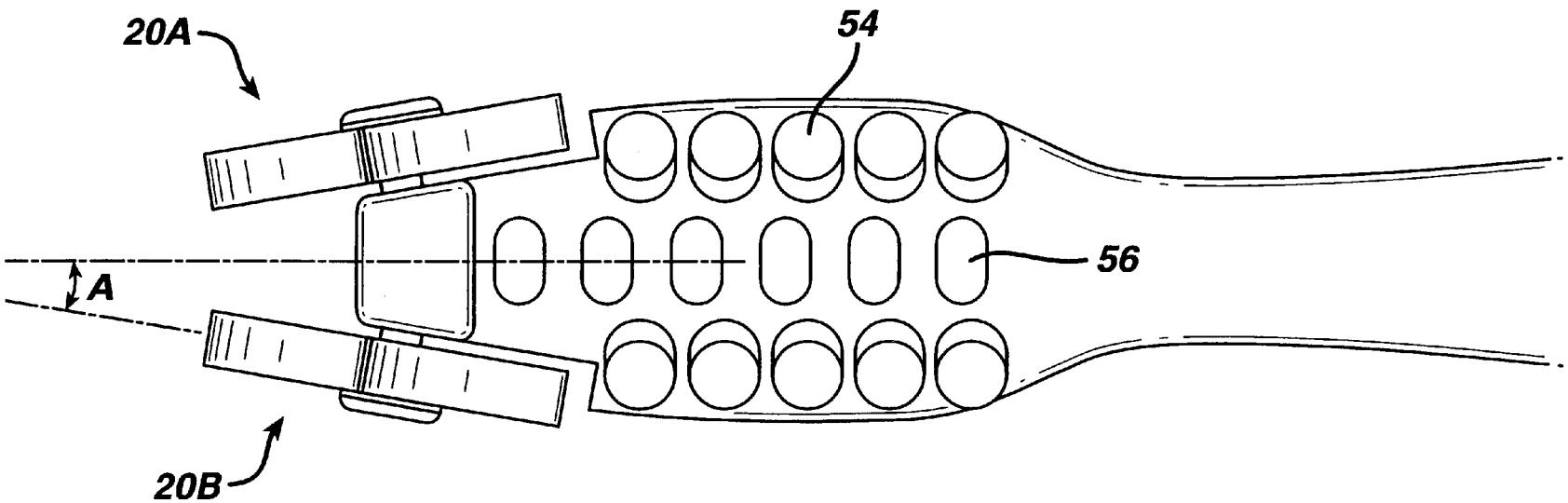
FIG. 5A is a top view of the oral brush shown in FIG. 5.

An alternate embodiment of the invention is shown in FIG. 5. In this embodiment, the oral brush 10 is provided with two wheels 20*a*, 20*b*. Wheels 20*a* and 20*b* are mounted on opposite sides of the brush head, and "toe-in" towards each other, i.e., their axes of rotation are not collinear. This arrangement has been found to facilitate penetration of the tips into the interproximal region when the oral brush is used on the inside surfaces of the teeth. The axes of rotation of the wheels 20*a*, 20*b* together define a horizontal plane that is substantially parallel to the top surface 17 of head 16. The angle A that is defined by the "toeing-in" of the wheels, shown in FIG. 5A, is from about5 to 45 degrees.

The oral brush shown in FIG. 5 also includes a plurality of tooth cleansing elements 54 extending from the top surface 17 of head 16, behind the wheels. Tooth cleansing elements 54 include bristle tufts constructed to clean along the gumline. The oral brush also includes a central row of bristle tufts 56 constructed to clean the flat surfaces of the teeth.

Figure 6:
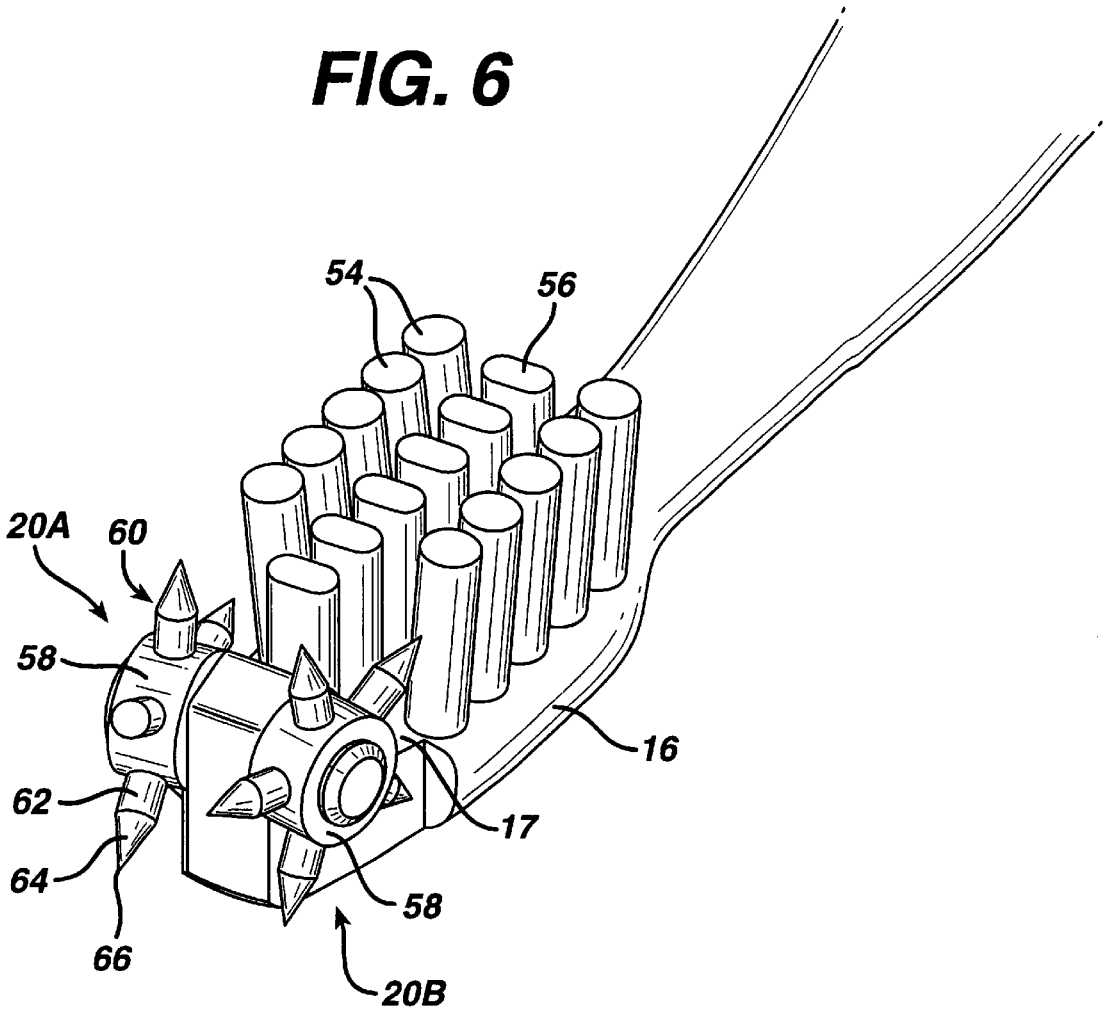

Yet another embodiment is shown in FIG. 6. In this case, wheels 20*a*, 20*b* include a center hub 58, and a plurality of semi-conical protrusions 60 extending radially from the hub. The hub is preferably formed of an elastomer, e.g., the KRATON rubber-based block copolymers described above. The hub diameter is preferably from about 0.05 to 0.20 inch. Preferably, protrusions 60 are bristle tufts, the ends of which are trimmed to form a conical portion 64 extending above cylindrical tuft body 62. The taper of the conical portion 64 to a pointed tip 66 allows the bristle tuft to more effectively penetrate the interproximal region. Preferably, the conical portion 64 has a tip diameter of from about 0.005 to 0.025 inch, while the diameter of the tuft body 62 is from about 0.02 to 0.10 inch. It is preferred that the overall length of the protrusions be from about 0.1 to 0.4 inch. The bristles may be formed of any material suitable for use in toothbrush bristles. Suitable materials include polyamides (e.g., Nylon 612, Amodel), acetyl resins, polyesters (e.g., polybutylene terephthalate (PBT)), fluoropolymers (.e.g., polyvinylidene difluoride (PVDF), fluorinated ethylene-propylene resin (FEP)), polyacrylates, polysulfones, and combinations thereof. Preferably, the bristles have a diameter of from about 0.003 to 0.008 inch. Alternatively, protrusions 60 can be formed of a single elastomeric bristle, molded to the desired semi-conical shape.

Figure 7:
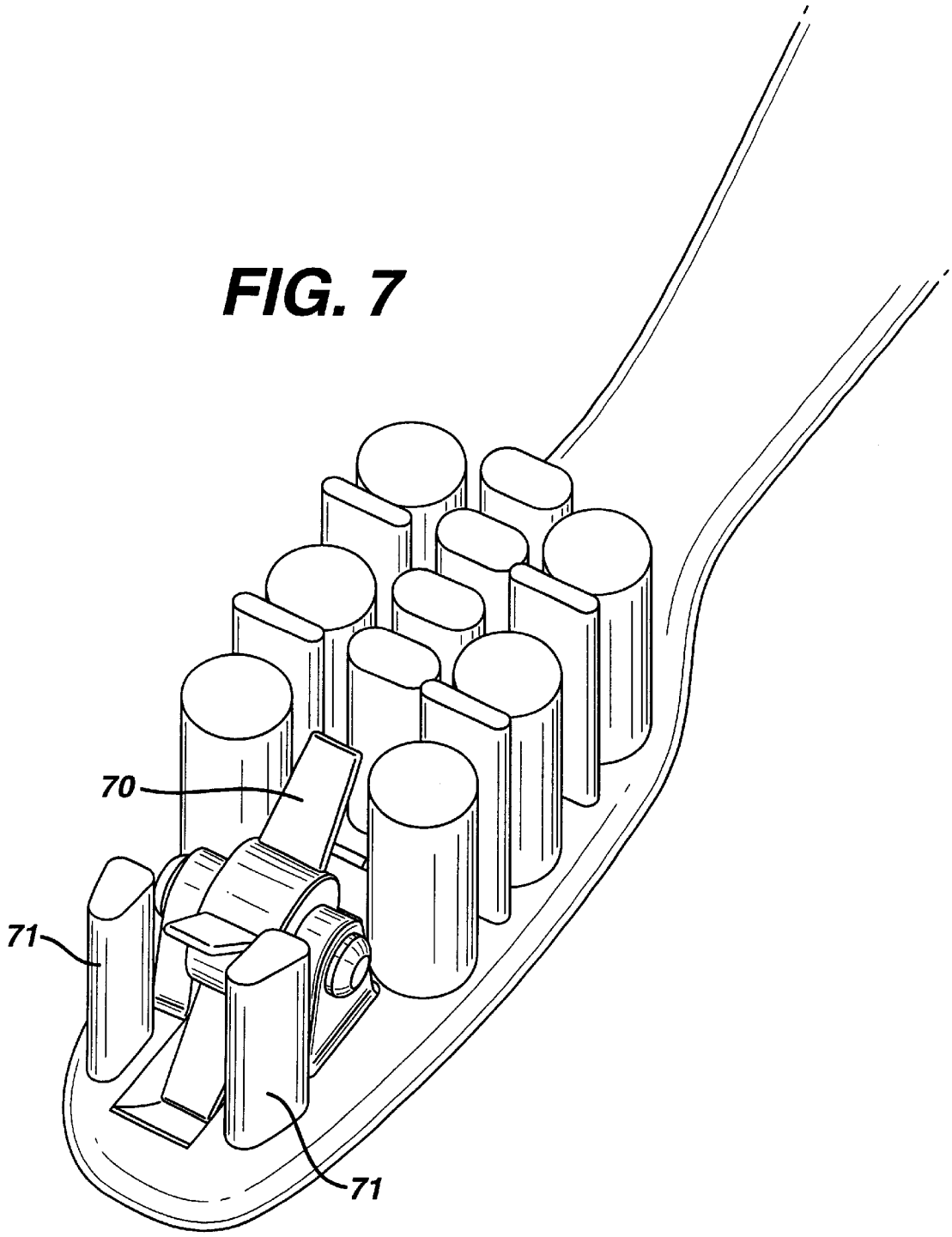

In a further embodiment, shown in FIG. 7, the semi-conical projections 60 shown in FIG. 6 are replaced by radially extending fins 70. Fins 70 are thin, substantially planar members, the planar surfaces of which extend substantially parallel to the axis of rotation of the wheel. Fins 70 are preferably formed of a thermoplastic elastomer, e.g., one of the thermoplastic elastomers discussed above. Alternatively, fins 70 can be formed of a row or a plurality of closely spaced rows of bristles. In either case, fins 70 will preferably have a thickness of from about 0.005 to 0.025 inch, a width of from about 0.02 to 0.15 inch, and a height of from about 0.1 to 0.4 inch. A pair of bristle tufts 71 are positioned forward of the wheel, to clean the back teeth.

Figure 8:
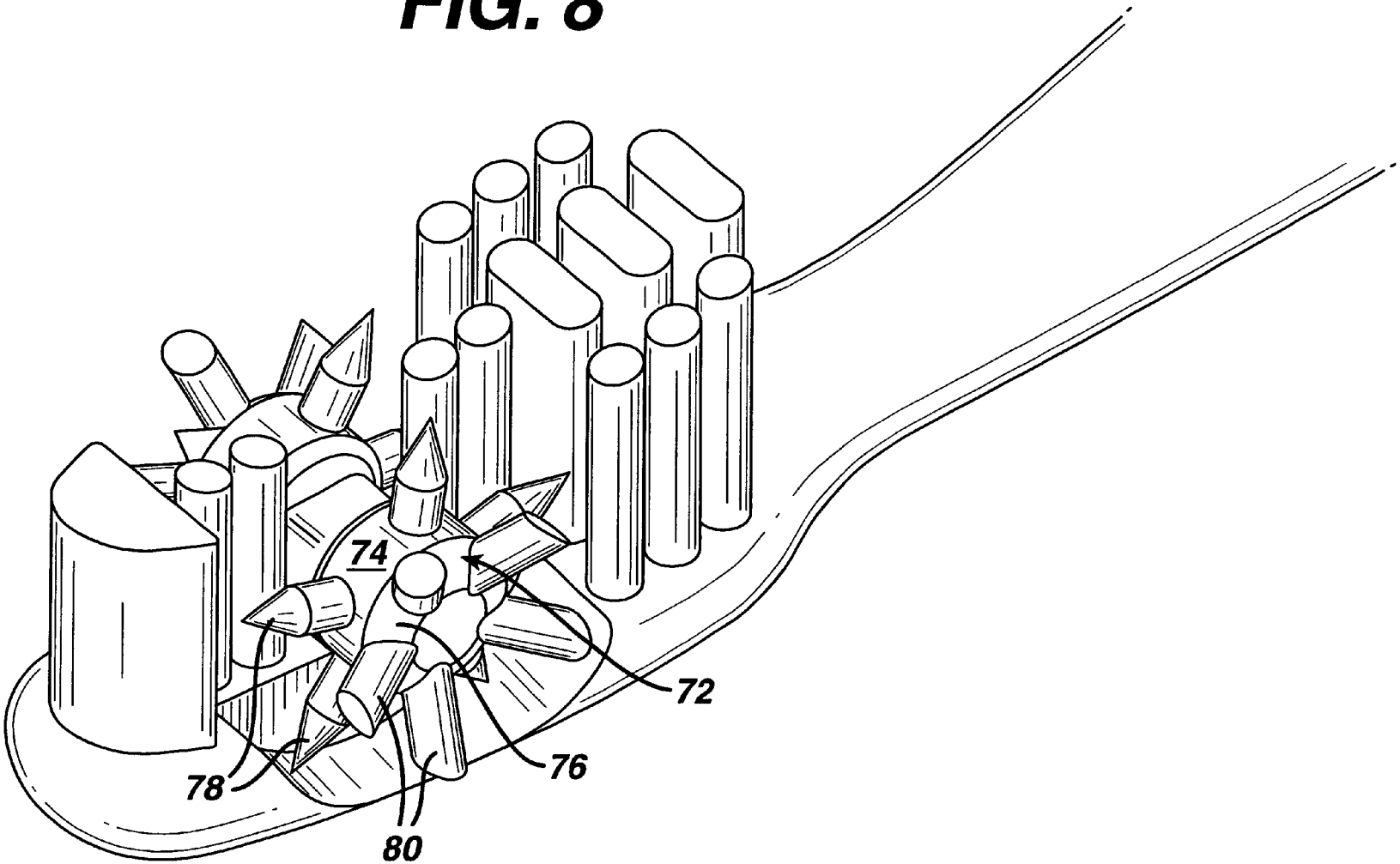

In the embodiment shown in FIG. 8, the rotatable element includes a central portion 72 having a hub 74 and a substantially hemispherical portion 76. A plurality of spaced protrusions 78 extend radially from the hub in a manner similar to the embodiments described above, for interproximal penetration. A plurality of gumline-sweeping protrusions 80 extend from the hemispherical portion 76 at spaced intervals so that the ends of their tips define a hemisphere. This configuration is thought to provide a "sweeping" effect along the gumline during brushing. The gumline-sweeping protrusions may be more closely spaced than the configuration shown, e.g., the hemisperical portion may include very closely spaced bristle tufts, creating a hemispherical surface of bristle ends. The gumline-sweeping protrusions preferably include soft bristles, e.g., nylon or PBT, having a diameter of from about 0.003 to 0.007 inch, and/or elastomeric protrusions such as the fins described above.

Referring to FIGS. 9, 9A, 10 and 10A, additional wheel 100, 101 embodiments are shown. Wheels 100, 101 can include a number of tapered members (i.e., protrusions) 102, 104 extending from a central hub but preferably include four, five or six members. These wheels 100, 101 preferably have a pitch (P), i.e., the circumferential distance between the tips of two members, of about 0.3 in. The four member wheels preferably have an outer diameter (OD), as measured from the tip of one member to the tip of an opposite member, of about 0.4 in. The five member wheels preferably have an outer diameter of about 0.5 in. The six member wheels preferably have an outer diameter of about 0.6 in. Preferably the tip length (L), as measured from the lowest point in the valley between two members to the tip of a member, as depicted by L in FIG. 9B, is from about 0.1 to about 0.4 in.

Figure 9A:
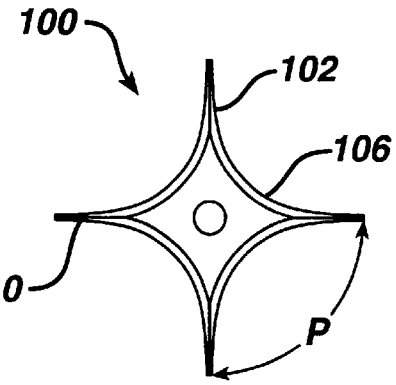
FIGS. 9A–C are, respectively, front plan views and a perspective view of a rotatable element according to another embodiment of the invention.
Figure 9B:
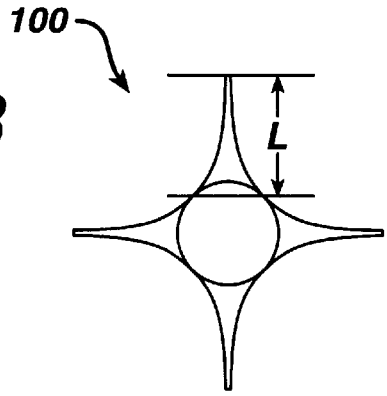
Figure 9C:
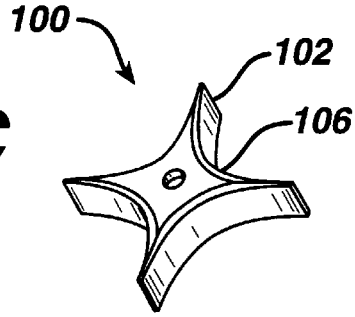
Figure 9D:
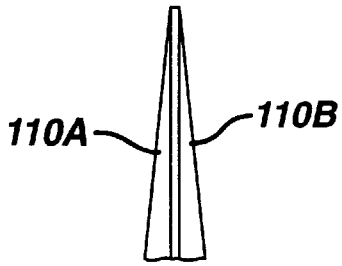
FIG. 9D is an enlarged view of the tip of a tapered member of the rotatable element of FIGS. 9A–C.
Figure 10A:
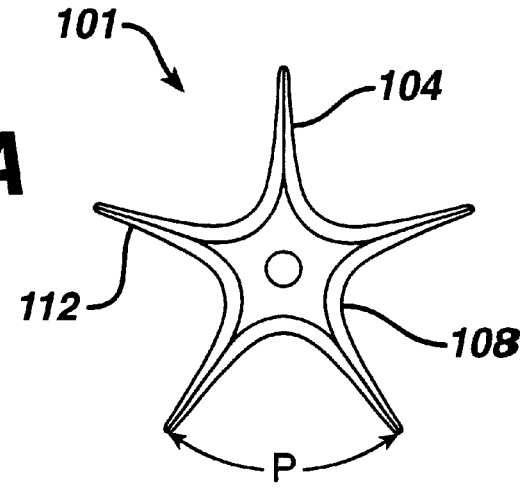
FIGS. 10A–B are, respectively, a front plan view and a perspective view of a rotatable element according to another embodiment of the invention.
Figure 10B:
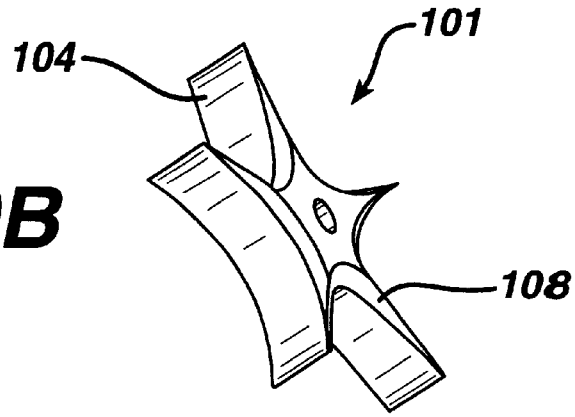
Figure 10C:
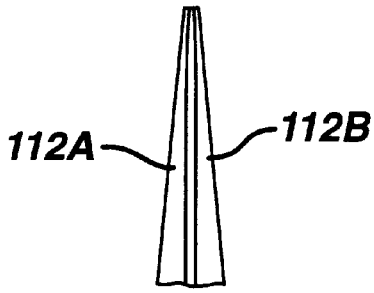
FIG. 10C is an enlarged view of the tip of a tapered member of the rotatable element of FIGS. 10A–B.
Figure 11:
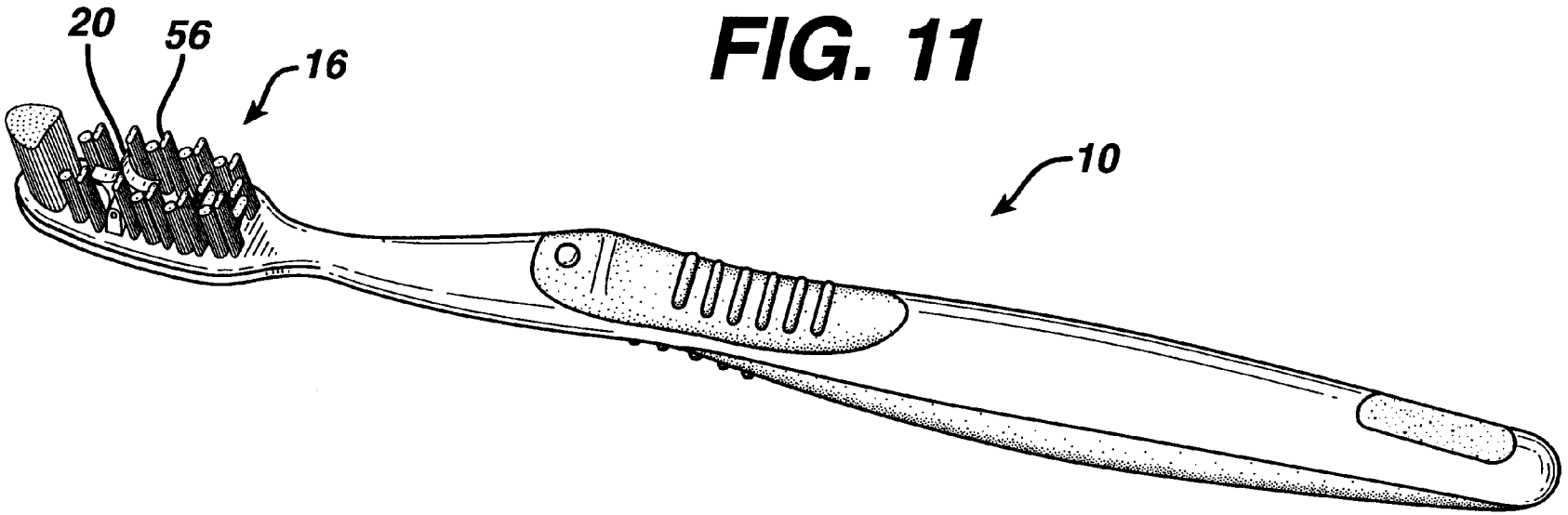
FIG. 11 is a perspective view of an oral brush according to another embodiment of the invention.
Figure 12:
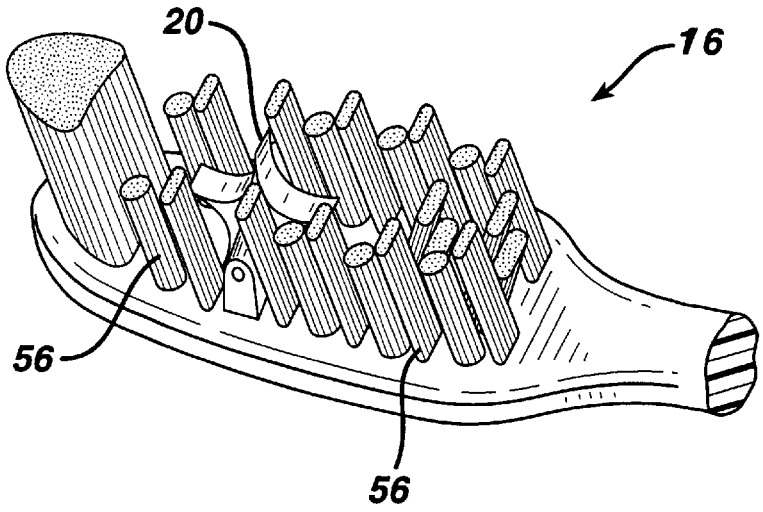
FIG. 12 is an enlarged detail view of the head of the oral brush of FIG. 11.
Figure 13:
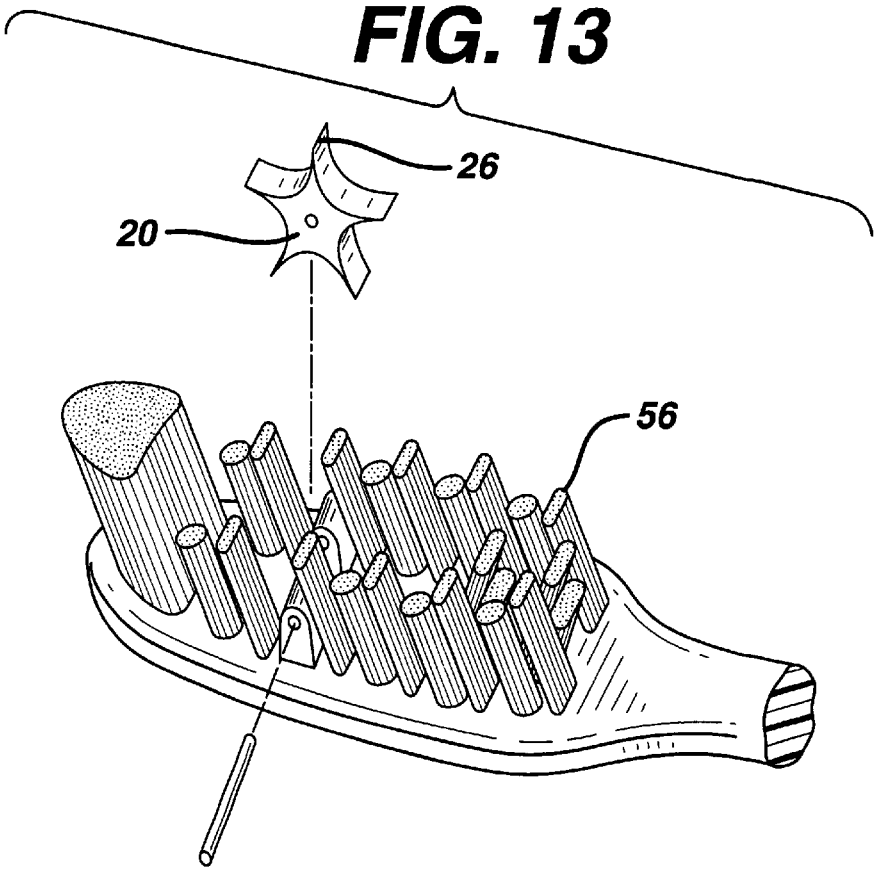
FIG. 13 is an exploded view of the head of the oral brush of FIG. 11.
Figure 14:
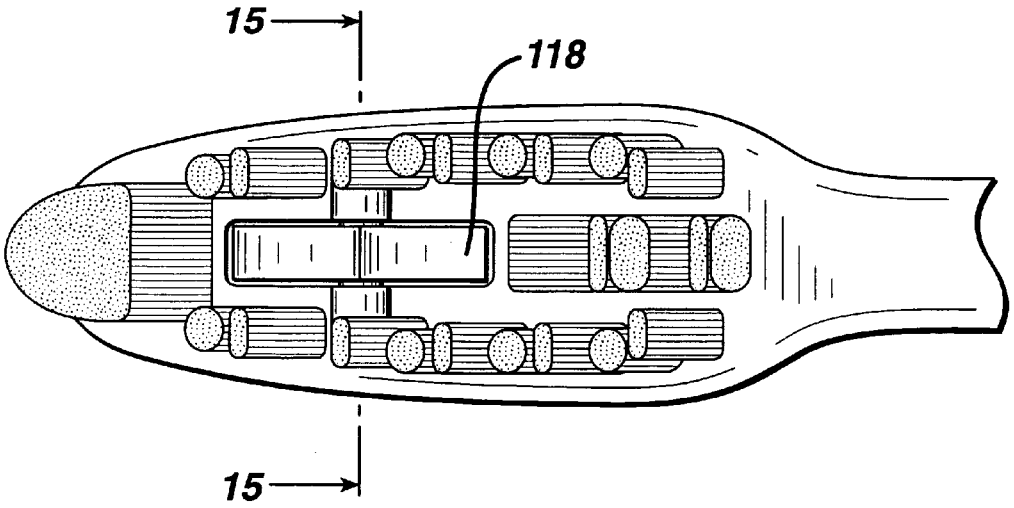
FIG. 14 is an enlarged detail view of the head of the oral brush of FIG. 11 with the rotatable element omitted for clarity.
Figure 15:
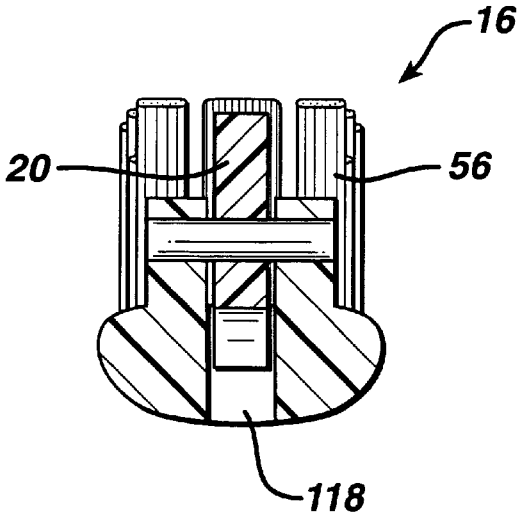
FIG. 15 is a view taken along line 15—15 of FIG. 14 depicting the rotatable member positioned in an opening in the oral brush of FIG. 11.
Figure 16:
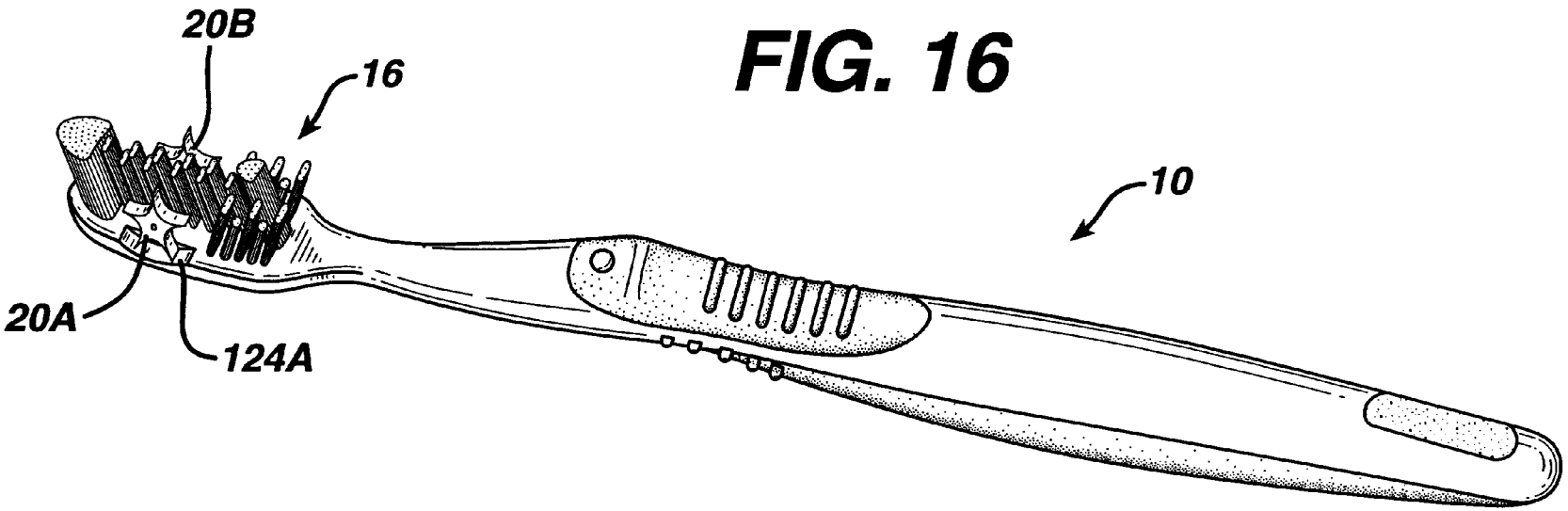
FIG. 16 is a perspective view of an oral brush according to another embodiment of the invention.
Figure 17:
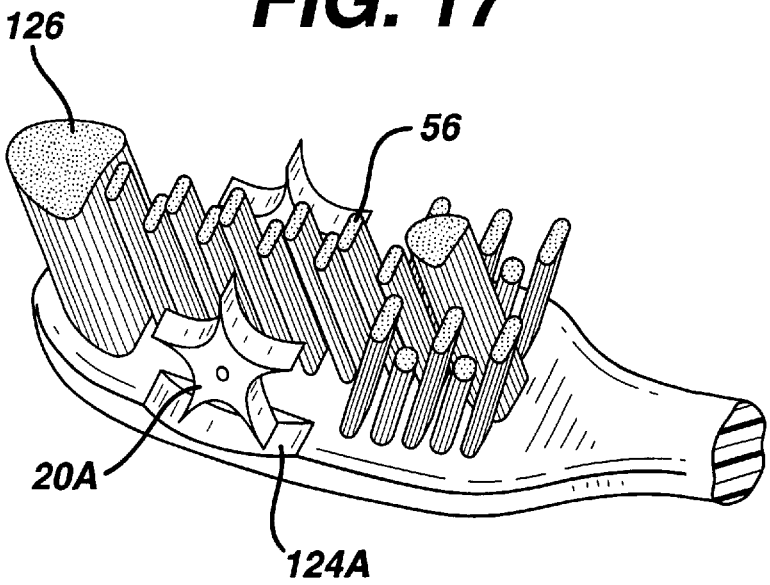
FIG. 17 is an enlarged detail view of the head of the oral brush of FIG. 16.
Figure 18:
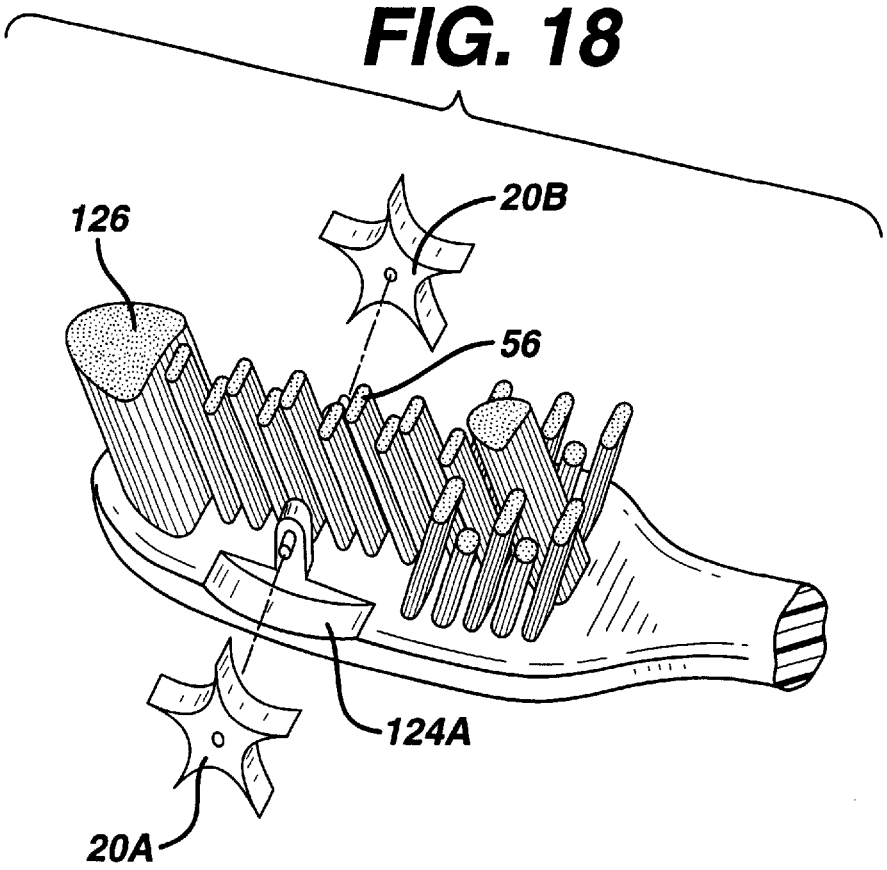
FIG. 18 is an exploded view of the head of the oral brush of FIG. 16.
Figure 19:
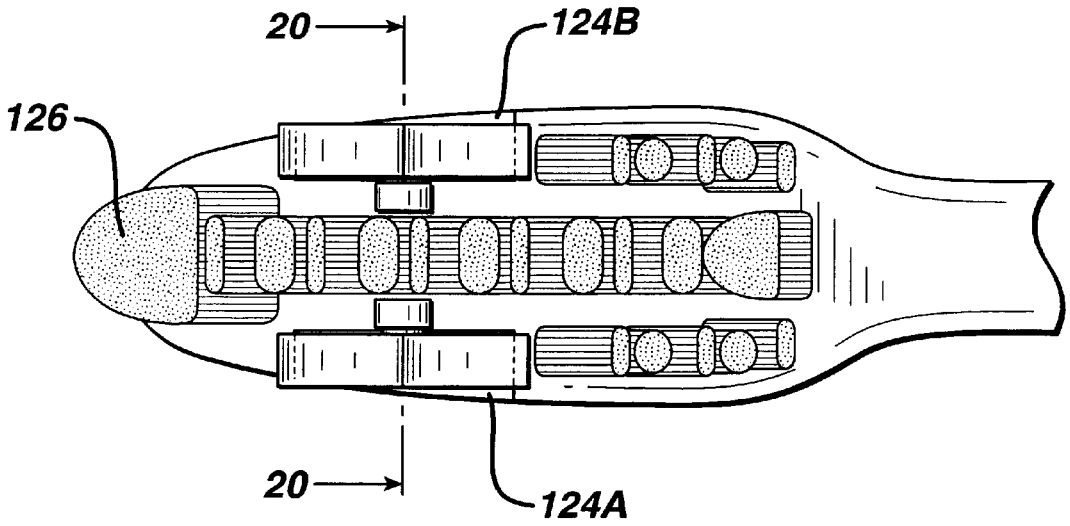
FIG. 19 is an enlarged detail view of the head of the oral brush of FIG. 16 with the rotatable elements omitted for clarity.
Figure 20:
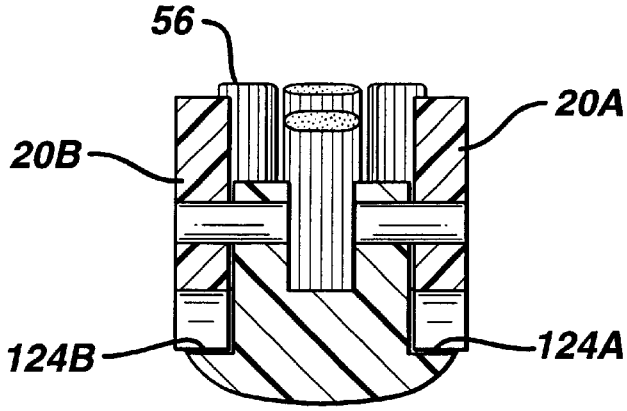
FIG. 20 is a view taken along line 20—20 of FIG. 19 depicting the rotatable members extending into wells in the oral brush of FIG. 16.

The edges 106, 108 of wheels 100, 101 are rounded to provide a smooth surface. Rounded edges 110A, 110B and 112A and 112B are also present on members 102, 104, as shown in FIGS. 9A and 10A. The rounded edges provide more comfort (i.e., relative to sharp edged wheels) to a user of the brush.

Referring to FIGS. 11–15, in another embodiment, a wheel 20 is positioned in the head 16 of the oral brush 10 such that the tapered members 26 of the wheel 20 extend into the opening 118 in the body 12 of the head 16 of the oral brush 10. The dimensions of the opening 118 and the tapered members 26 of the wheel 20 are preferably such that the wheel 20 is able to rotate freely. Tufts 56 of bristles surround the wheel 20. The tufts 20 of bristles can extend from the body 12 of the head 16 to a variety of heights including being shorter, taller and equal relative to the height of the tapered members 26 of the wheel 20.

Referring to FIGS. 16–20, in another embodiment, two wheels 20A, 20B are positioned on the head 16 of the oral brush 10 such that the wheels 20A, 20B extend into wells 124A, 124B in the body 12 of the head 16. The wheels 20A, 20B are positioned between the toe tuft 126 and other tufts 56 of bristles on the oral brush 10. Tufts 56 of bristles are also positioned between wheels 20A, 20B. The tufts 56 of bristles can extend from the body 12 to a variety of heights including being shorter, taller and even relative to the height of the tapered members 26 of the wheel 20.

Other embodiments are within the claims.

For example, while the invention has been described above in the context of an oral brush having tooth cleansing elements, e.g., tufts of bristles, the rotatable element can also be mounted on an oral device that does not include tooth cleaning elements. Such an oral device can be used to clean and massage the gums and interproximal region, with a conventional toothbrush being used separately to clean the teeth.

Moreover, while the rotatable element is preferably capable of 360° rotation, in some cases it may be desirable to limit the rotation of the rotatable element to less than 360°.

Further, while FIG. 6 shows two wheels and FIG. 7 shows a single wheel, the types of wheels shown in these figures can be used either alone or as a pair.

Additionally, the oral brush may include more than two wheels.

What is claimed is:

1. A oral brush comprising a body having a head that is shaped for insertion into the oral cavity, tooth cleansing elements extending from a top surface of the head, and a rotatable element, mounted on the head to rotate about an axis of rotation, including a central portion ad a plurality of tapered members extending radially from the central portion, each tapered member comprising a unitary body tapering from a relatively wide base to a relatively narrow tip, the tip defining linear surfaces that are generally parallel to each other and defining a distal edge that is generally parallel to the axis of rotation, the tip being constructed to penetrate the interproximal region.

2. The oral brush of claim 1 wherein the rotatable element is mounted to rotate about an axis of rotation that is substantially parallel to the top surface of the head.

3. The oral brush of claim 1 wherein the head includes a slot positioned to allow the rotatable element to rotate freely.

4. The oral brush of claim 1 wherein the rotatable element includes a web extending axially from an outer edge of the rotatable element, to contact the gums during rotation of the rotatable element.

5. The oral brush of claim 1 wherein the dimensions of the rotatable element and the number of tapered members are selected so that the tips are circumferentially spaced at intervals that correspond approximately to the average spacing of human teeth.

6. The oral brush of claim 1 wherein the ends of said tips define a circle or a hemisphere.

7. The oral brush of claim 1 wherein the tips are shaped to penetrate the interproximal and subgingival regions of the oral cavity.

8. The oral brush of claim 1 wherein the tips have a thickness of less than 0.07 inch.

9. The oral brush of claim 1 wherein the tips have a thickness of from about 0.005 to 0.025 inch.

10. The oral brush of claim 1 wherein the tips have a length of from about 0.1 to 0.4 inch.

11. The oral brush of claim 1 wherein the tips are formed of a material having a durometer reading of from about 25 to 85 Shore A.

12. The oral brush of claim 1 wherein the tips are formed of a material having a durometer reading of from about 55 to 75 Shore A.

13. The oral brush of claim 1 wherein the tips are formed of a thermoplastic elastomer.

14. The oral brush of claim 1 wherein the rotatable element is a single, integral part.

15. The oral brush of claim 14 wherein the rotatable element is formed of a thermoplastic elastomer.

16. The oral brush of claim 1 wherein the tooth cleansing elements are selected from bristles, fins and elongated elastomeric members.

17. The oral brush of claim 1 further comprising a second rotatable element.

18. The oral brush of claim 17 wherein each rotatable element is mounted to rotate about an axis of rotation that is substantially parallel to the top surface of the head.

19. The oral brush of claim 17 wherein the axes of rotation of the rotatable elements are not collinear.

20. The oral brush of claim 19 wherein the axes of rotation of the rotatable elements define an angle of from about 5 to 45 degrees.

21. The oral brush of claim 17 wherein the rotatable elements are positioned at the end of the head.

22. The oral brush of claim 17, wherein the body of the head further comprises:

a first well extending into to a first portion of the body; and a second well extending into a second portion of the head, the first wheel being mounted to extend into the area defined by the first well, and the second wheel being mounted to extend into the area defined by the second well.

23. The oral brush of claim 1 wherein the body of the head includes an opening extending from a first surface of the body to a second surface of the body, and the rotatable element extends into the opening.

24. The oral brush of claim 1 wherein the tips are formed of a material having a durometer reading of from about 55 Shore A to about 85 Shore A.

25. The oral brush of claim 1 wherein the tips are formed of a material having a durometer reading of from about 65 Shore A to about 80 Shore A.

26. The oral brush of claim 1, wherein the rotatable element has a pitch of about 0.3 in.

27. The oral brush of claim 1 wherein the tapered members are integrally formed of an elastomeric material having a durometer reading of from about 55 to about 85 Shore A.

28. The oral brush of claim 1 wherein the tapered members are integrally formed of an elastomeric material having a durometer reading of from about 65 to about 80 Shore A.

29. The oral brush of claim 1 wherein the tapered members are integrally formed of an elastomeric material having a durometer reading of from about 70 to about 75 Shore A.

30. An oral brush comprising a body having a head that is shaped for insertion into the oral cavity, tooth cleansing elements extending from a top surface of the head, and a rotatable element, mounted on the head to rotate about an axis of rotation, including a central portion and a plurality of tapered members extending radially from the central portion, the tapered members comprised of unitary bodies including tips, each tip defining linear surfaces that are generally parallel to each other and defining a distal edge that is generally parallel to the axis of rotation, and having a tip thickness at the distal edge of less than 0.03 inch.

31. The oral brush of claim 30 wherein said rotatable element is substantially star-shaped.

32. The oral brush of claim 31 wherein said rotatable element comprises an integral elastomeric member.

33. An oral care device that includes a body having a head shaped for insertion into the oral cavity, and a rotatable element mounted on the head to rotate about an axis of rotation, including a central portion and a plurality of tapered members extending radially from the central portion, each tapered member comprising a unitary body tapering from a relatively wide base to a relatively narrow tip, the tip defining linear surfaces that are generally parallel to each other and defining a distal edge that is generally parallel to the axis of rotation, the tip being constructed to penetrate the interproximal region.

34. The oral care device of claim 33 further comprising a second rotatable element wherein the rotatable elements are mounted so that their axes of rotation are not colinear.

35. An oral brush comprising a body having a head that is shaped for insertion into the oral cavity, tooth cleansing elements extending from a top surface of the head, and a rotatable element, mounted on the head to rotate about an axis of rotation, the rotatable element including a central portion and a plurality of tapered members extending radially from the central portion, each tapered member tapering from a relatively wide base to a relatively narrow tip and being integrally formed of an elastomeric material, and each tip defining a distal edge that is generally parallel to the axis of rotation, and having a tip thickness at the distal edge of less than 0.07 inch.

* * * * *

UNITED STATES PATENT AND TRADEMARK OFFICE

CERTIFICATE OF CORRECTION

PATENT NO. : 6,389,634 B1 
DATED : May 21, 2002
INVENTOR(S) : Thomas E. Devlin, Michael Roberts and Phillip M. Braun It is certified that error appears in the above-identified patent and that said Letters Patent is hereby corrected as shown below:

Title page,
Item [56], OTHER PUBLICATIONS, delete "Siamak" and replace with -- Doroodian-Shosa Siamak --.

Signed and Sealed this

Seventh Day of January, 2003

JAMES E. ROGAN
*Director of the United States Patent and Trademark Office*